US009598919B1

(12) United States Patent
Cantrell et al.

(10) Patent No.: US 9,598,919 B1
(45) Date of Patent: Mar. 21, 2017

(54) MODIFIED FILTER SCREEN

(71) Applicant: Reme, L.L.C., Conroe, TX (US)

(72) Inventors: William Jay Cantrell, Kingston, OK (US); Faraz Ali, Friendswood, TX (US)

(73) Assignee: REME, L.L.C., Conroe, TX (US)

( * ) Notice: Subject to any disclaimer, the term of this patent is extended or adjusted under 35 U.S.C. 154(b) by 0 days.

(21) Appl. No.: 15/093,417

(22) Filed: Apr. 7, 2016

Related U.S. Application Data

(63) Continuation-in-part of application No. 14/871,433, filed on Sep. 30, 2015, now abandoned.

(51) Int. Cl.

| | |
|---|---|
| ***E21B 21/01*** | (2006.01) |
| ***E21B 21/06*** | (2006.01) |
| ***B01D 29/33*** | (2006.01) |
| ***B01D 35/02*** | (2006.01) |
| ***E21B 3/02*** | (2006.01) |

(52) U.S. Cl.
CPC ..... *E21B 21/065* (2013.01); *B01D 29/33* (2013.01); *B01D 35/02* (2013.01); *E21B 3/02* (2013.01); *B01D 2201/4092* (2013.01)

(58) Field of Classification Search
CPC .... E21B 2021/007; E21B 21/01; E21B 21/02; E21B 21/06; E21B 21/063; E21B 21/065; E21B 27/005; E21B 3/02; B01D 27/04; B01D 29/0018; B01D 29/0043; B01D 29/085; B01D 29/13; B01D 35/04; B01D 2221/04; B01D 2201/0415
See application file for complete search history.

(56) References Cited

U.S. PATENT DOCUMENTS

| | | | | |
|---|---|---|---|---|
| 3,023,810 | A * | 3/1962 | Anderson | E21B 27/005 166/227 |
| 4,495,073 | A | 1/1985 | Beimgraben | |
| 4,756,826 | A | 7/1988 | Horvath | |
| 4,871,455 | A | 10/1989 | Terhune | |
| 4,896,570 | A | 1/1990 | Bourgeois | |
| 6,189,617 | B1 | 2/2001 | Sorhus et al. | |
| 7,165,633 | B2 * | 1/2007 | Hall | E21B 21/002 166/228 |
| 7,275,594 | B2 * | 10/2007 | Hall | E21B 17/10 166/227 |

(Continued)

FOREIGN PATENT DOCUMENTS

| | | |
|---|---|---|
| CN | 104563901 | 4/2015 |
| JP | 2014140518 | 8/2014 |

OTHER PUBLICATIONS

PCT, PCT/US2015/53312, International Search Report and Written Opinion, Dec. 28, 2015.

*Primary Examiner* — Cathleen Hutchins
(74) *Attorney, Agent, or Firm* — Morgan, Lewis & Bockius LLP

(57) ABSTRACT

A modified filter screen for use in a downhole drilling operation is disclosed. The filter screen is able to be installed at the surface of a well, and is pin-loaded for easy access and maintenance. The modified filter screen may be retained within a section of pipe below the top drive above the rig floor by allowing dowel pins on the section of pipe to engage with latch slots on the filter screen. The modified filter screen may also be retained by engaging a threaded connector on the filter screen with a threaded connector on the interior of the section of pipe or by utilizing pins and/or retaining rings.

16 Claims, 6 Drawing Sheets

(56) References Cited

U.S. PATENT DOCUMENTS

| | | | |
|---|---|---|---|
| 2004/0079551 | A1 | 4/2004 | Herst |
| 2005/0121232 | A1 | 6/2005 | Rudd et al. |
| 2010/0181243 | A1 | 7/2010 | Dworatzek et al. |
| 2014/0116681 | A1 | 5/2014 | Broussard, Jr. |

* cited by examiner

MODIFIED FILTER SCREEN

CROSS-REFERENCE TO RELATED APPLICATION

This application is a continuation-in-part of U.S. patent application Ser. No. 14/871,433, filed on Sep. 30, 2015, which is also incorporated by reference in its entirety herein.

BACKGROUND

1. Field of the Invention

The present invention relates to filter screens used in downhole drilling technologies in the oil and gas industry.

2. Description of the Related Art

In the oil and gas industry, downhole drilling operations may drill boreholes that extend thousands of feet into the ground. A fluid called drilling mud is used to facilitate drilling. As shown in FIG. 1, drilling mud circulates through the drilling system. Mud pumps 110 pump the mud from mud tanks 105 located at the surface. The mud gets pumped through the kelly hose 115 and the top drive 120. The mud is further pumped through the drill string, or drill pipe, 125 to the bottom hole assembly 130. As it reaches the bottom of the borehole, the mud acts to cool and clean the drill bit 135. The mud also picks up rock formation cuttings and circulates them back up through the annulus 140 between the drill string and casing back through the blowout preventers 145 to the surface. At this point, the mud gets processed through a shale shaker 150 before returning to mud tanks 105 to start the process of being pumped downhole again.

As the mud circulates through this system, it may pick up significant amounts of debris, which can affect the flow of the mud and the operation of the drill bit and other tools. A filter screen subassembly may be installed in the drill string to help collect and filter debris. Downhole filter screens are often run during directional drilling and are typically installed near the drill bit at the bottom of the drill string, and thus are not easily accessible during drilling. To remove or clean out a downhole filter screen, the entire drill string must be pulled out of the wellbore. Downhole filter screens typically employ flanges to be secured in a section of drill string. The flanges necessitate the insertion and removal of the existing filter screens from the box end (i.e., uppermost end) of a drill string section.

Additionally, downhole filter screens are easily damaged during drilling operations. If a filter screen fills with debris and is not properly maintained or cleaned, then it can cause blockages in the fluid flow or potentially "wash out." In other words, the filter screen may shear off due to excess debris buildup or excess vibration during drilling operations. The broken filter screen can be pushed by the fluid flow of the drilling mud and may end up at the bottom of the borehole. Due to the inconveniences from factors such as installation, cleaning, and maintenance, filter screens are often not used by drilling operators despite the benefits they provide in filtering drilling mud.

Surface pipe screens are also sometimes used to filter drilling mud. These pipe screens are installed in the drill string above the surface at the drilling rig, and they are designed to catch finer particulates than downhole filter screens. However, they are typically not built as robustly as downhole filter screens and require constant maintenance. They typically installed at the box end of a pipe segment and are held in place using a flange. Surface pipe screens also require constant maintenance. Each time a new drill pipe segment is ready to be added to the drill string, the top drive must be disconnected from the drill string. Before connecting the new drill pipe segment, the installed surface pipe screen must be removed from the topmost exposed segment (i.e., box end) of drill pipe in the drill string. After the new drill pipe segment is connected to the drill string, the surface pipe screen can be reinstalled into the new drill pipe segment's box end, and the top drive can be reconnected with the drill string. If the surface pipe screen is ever forgotten when adding new segments of pipe, the surface pipe screen may become "lost" in the drill string, making its retrieval difficult and tedious. Further, if a surface pipe screen ever shears off, it may become lodged along with debris anywhere in the drill string.

Additionally, surface pipe screens can present safety issues. Many drilling operators enforce a safety zone around the drill string when the top drive is disconnected from the drill string because it is a pinch point. Many operators forgo the use of surface pipe screens, rather than risk the safety of personnel during the frequent insertion and removal of a surface pipe screen during drilling operations.

Accordingly, there exists a need for the safe and easy attachment and removal of a filter screen that is constantly positioned at the surface of a drilling rig.

SUMMARY OF THE INVENTION

The following invention presents a novel modified filter screen design. The filter screen is able to be installed at the surface of a well, it does not need to be removed and reinstalled when additional segments are added to the drill string, and it may be loaded into the pin end (i.e., the bottom end) of a segment near the top drive for easy access and maintenance.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DETAILED DESCRIPTION

Figure 1:
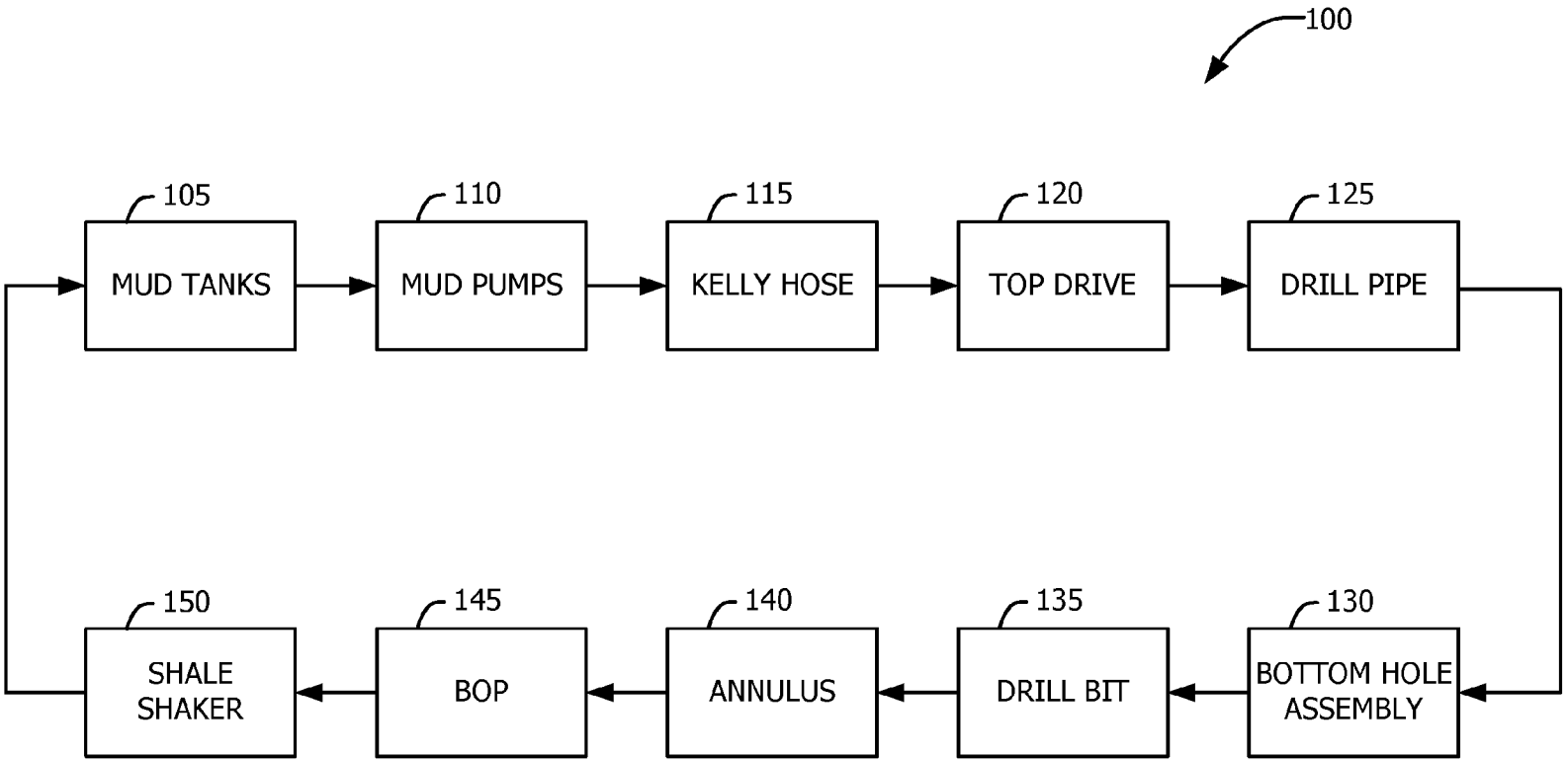
FIG. 1 is a flow diagram illustrating how drilling mud may flow through a drilling system as per the prior art.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 2:
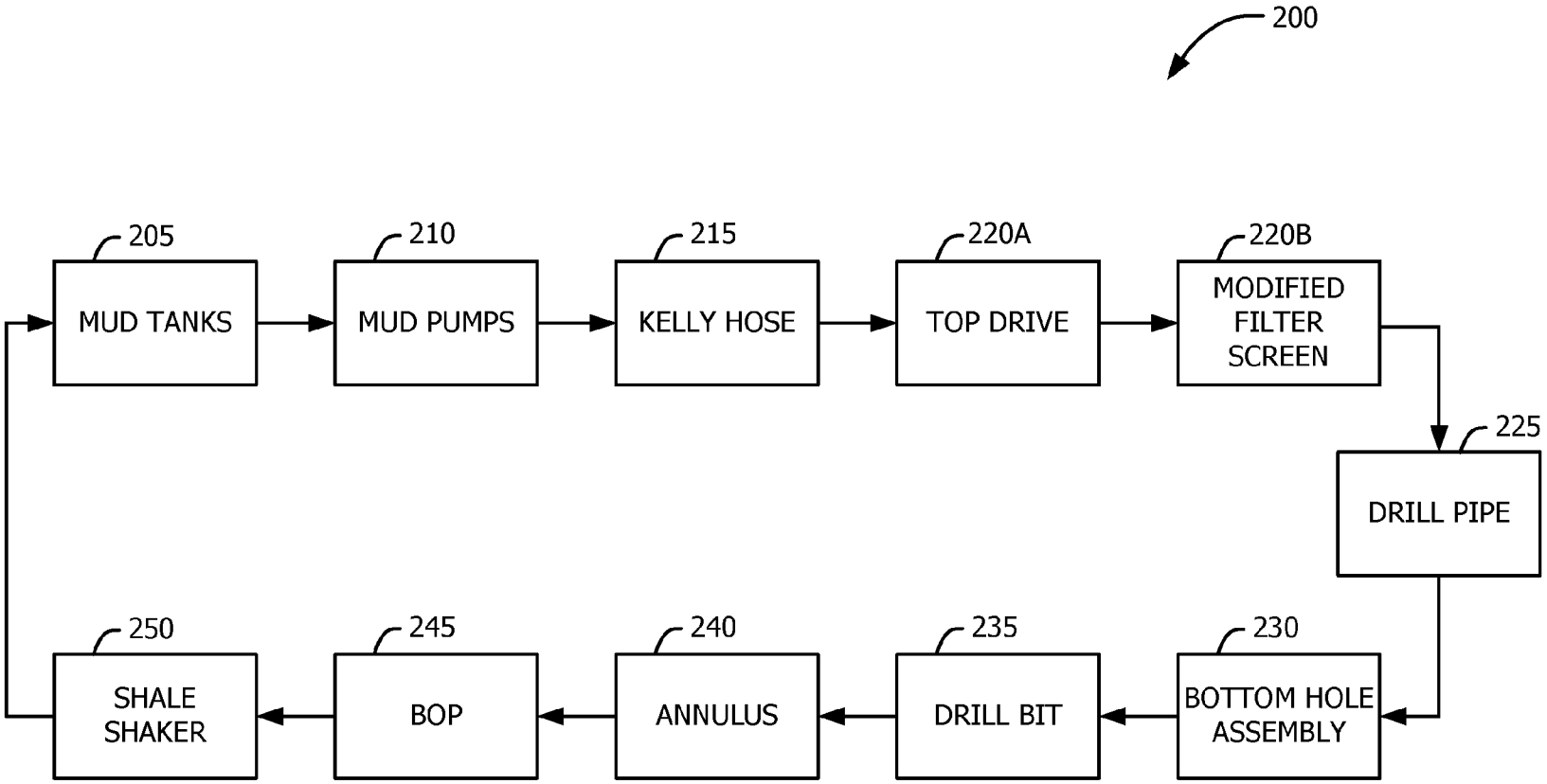
FIG. 2 is a flow diagram illustrating how drilling mud may flow through a drilling system using the present invention.
Figure 3:
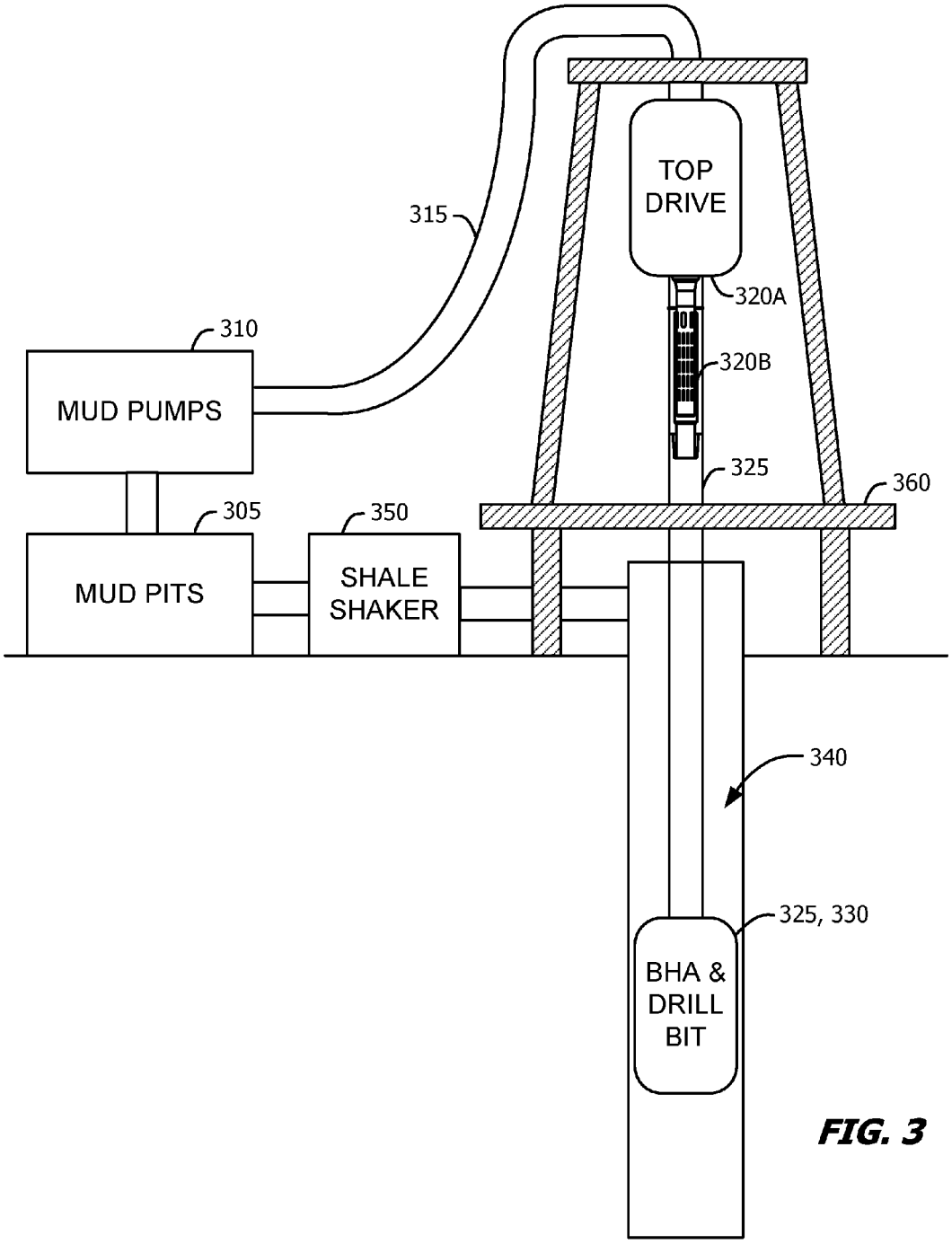
FIG. 3 is a diagram of a drilling system illustrating the use of the present invention.

As referenced above, FIG. 1 shows a typical flow diagram of how drilling mud may flow through a downhole drilling system as per the prior art. FIG. 2 shows a flow diagram of how drilling fluid may flow through a downhole drilling system using the modified filter screen 220B. Elements in FIG. 2 are analogous to their similarly numbered counterparts in FIG. 1. The top drive 220A is a portion of the drill rig that includes one or more motors used to rotate the drill string during drilling. The top drive 220A connects to the drill string 225 by a section of pipe sometimes referred to as the quill. The modified filter screen 220B is inserted into the quill or into a filter sub that may be installed just below the top drive assembly 220A. In FIG. 3, the location of the modified filter screen 320B is shown in the context of a top drive assembly 320A and the drilling rig floor 360.

Figure 4A:
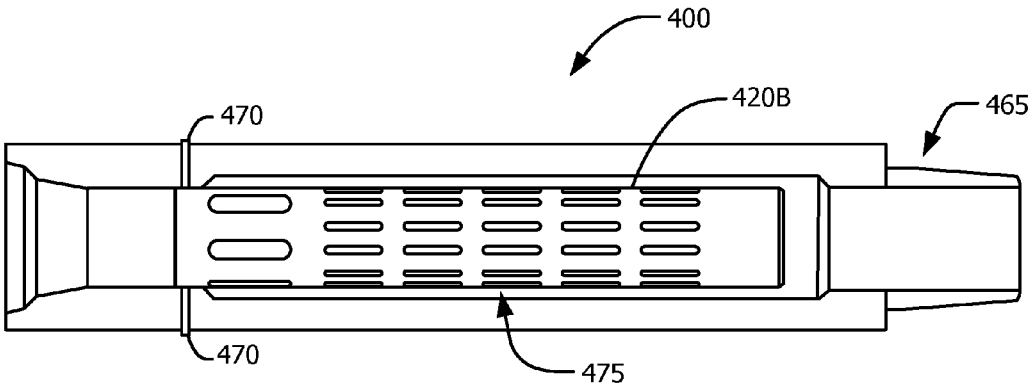
FIG. 4A illustrates the positioning of one embodiment of a modified filter screen in a top drive assembly.
Figure 4B:
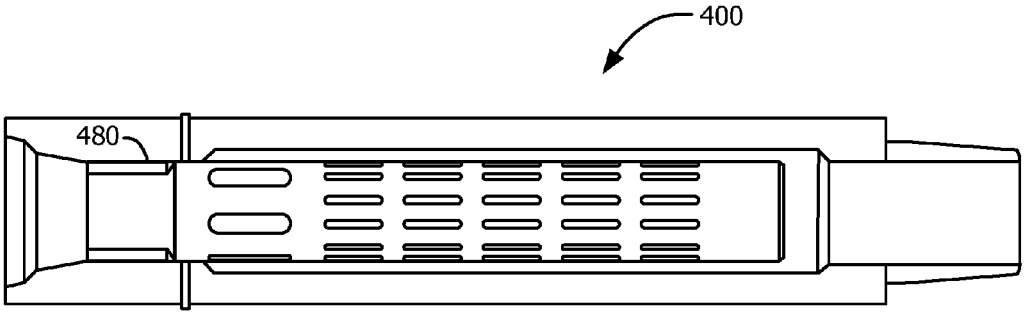
FIG. 4B illustrates the positioning of one embodiment of a modified filter screen in a top drive assembly with an inner shoulder.

FIGS. 4A and 4B show two embodiments of a filter sub 400 that may be used to house the modified filter screen. The filter sub remains connected to the top drive when the top drive is disconnected from the drill string. The modified filter screen is inserted into the filter sub from the pin end—the bottom end—of the filter sub. This allows for ease of insertion and removal of the modified filter screen from the filter sub. Because the top drive can be locked out, inserting the filter screen or filter sub from the pin end does not pose the same safety risks that occur when inserting or removing a traditional surface pipe screen from the box end of the drill string. Referring briefly again to FIG. 3, the drill string 325 may be disconnected from the top drive 320A to add, remove, or service sections of drill string. When this occurs, the top drive assembly 320A and filter sub will be hanging from the drill rig structure, and the modified filter screen 320B may be inserted or removed into the filter sub. If the filter sub has not been installed, the filter sub may be installed at such times as well. The top drive 320A employs a handling arm (not shown) that is used to make up the connection between the top drive 320A and the drill string 325. The filter sub, when it is installed at the top drive 320A, should be shorter than the length of the handling arm to allow the handling arm to access the drill string 325 during make up. Because handling arms are typically at most three feet in length, the filter sub may preferably be two feet in length, and the modified filter screen 320B may be shorter than the filter sub.

Returning to FIG. 4A, one embodiment of a filter sub 400 with a modified filter screen 420B is shown. The modified filter screen 420B is shown with slots to filter debris, and various combinations of slots and holes may be used. As mentioned above, the modified filter screen 420B is able to be inserted from the pin side 465 of the filter sub 400. The modified filter screen 420B is pushed until it engages with dowel pins 470 installed in the side wall of the filter sub. The dowel pins 470 engage with J-latches at the top end of the modified filter screen, as will be described in further detail below. The dowel pins 470 may be made of a steel alloy or another alloy with a high strength rating, such that the dowel pins will not shear and cause the modified filter screen to wash out during drilling operations.

During drilling operations, mud will flow into the modified filter screen 420B from the top drive. As debris collects at the bottom of the modified filter screen, mud flow may be diverted through the sides of the modified filter screen 420B into the annular passage 475 within the filter sub 400 with a slightly larger diameter than the outside diameter of the modified filter screen 420B. The mud will then flow through the remainder of the filter sub into the drill string. In the embodiment shown in FIG. 4A, the top of the modified filter screen which engages with the dowel pins 470 in the filter sub 400 is not flush with the internal wall of the filter sub, potentially exposing it to wear caused by mud flow during drilling operations. In other words, the inner diameter of the modified filter screen 420B may be smaller than the inner diameter of the filter sub 400.

The embodiment of the filter sub 400 shown in FIG. 4B limits this potential wear. In this embodiment, the filter sub has a beveled internal shoulder 480. The internal shoulder 480 acts as a stop for the modified filter screen 420B during insertion, and also acts to allow the internal diameter of the filter sub to be substantially similar to or the same as the internal diameter of the modified filter screen 420B.

Figure 5:
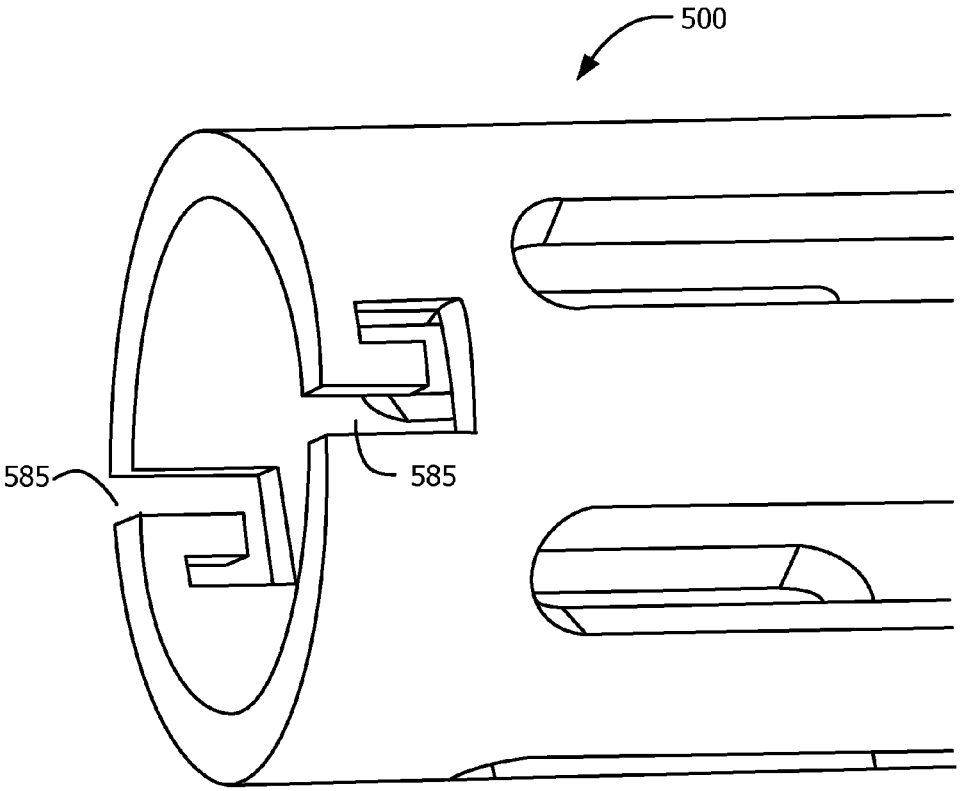
FIG. 5 illustrates the latching mechanism by which one embodiment of the modified filter screen is held in the top drive assembly.

Referring to FIG. 5, the J-latch 585 of the modified filter screen 500 is shown. The design of the J-latch 585 for the modified filter screen 500 allows for the entire modified filter screen 500 to be a cylinder with consistent inner and outer diameters, which allows for insertion of the modified filter screen from the pin end of the filter sub. In some embodiments, the modified filter screen may be tapered or not completely cylindrical. For insertion, the modified filter screen 500 is inserted into the pin end of the filter sub, pushed and rotated until the opening longitudinal channel in the J-latches engage with the dowel pins of the filter sub. The modified filter screen should be pushed and rotated until it follows the "J" path and is locked in the filter sub. For removal, the reverse path of the J-latch is followed until the modified filter screen is free from the dowel pins.

In some embodiments, paths other than a "J" path may be used to lock the modified filter screen into the dowel pins of the filter sub. For example, the modified filter screen may use a "C" or an "S" slot. With these or other slot shapes, the filter screen may be pushed and rotated until the respective path is traversed and the filter screen is retained within the filter sub. The various slots—"J," "C," "S," or other—should be configured to axially and circumferentially retain the filter screen.

A specialized tool may be used to insert and remove the modified filter screen from the filter sub. Because the modified filter screen is inserted through the pin end of the filter sub, the insertion/removal tool connects to the bottom end of the modified filter screen. In one embodiment, the insertion/removal tool may include fingers that align with slots or holes at the bottom of the modified filter screen. The fingers of the insertion/removal tool are inserted into the bottom of the filter screen, and the modified filter screen may be pushed up through the pin end of the filter sub to engage the J-latches with the dowel pins. During removal, the "J" path (or other path) is traversed in reverse, and gravity allows the filter sub to be removed. In one embodiment of the insertion/removal tool, the tool has a latch mechanism to hold the modified filter screen and allow it to be pulled out of the filter sub.

Figure 6A:
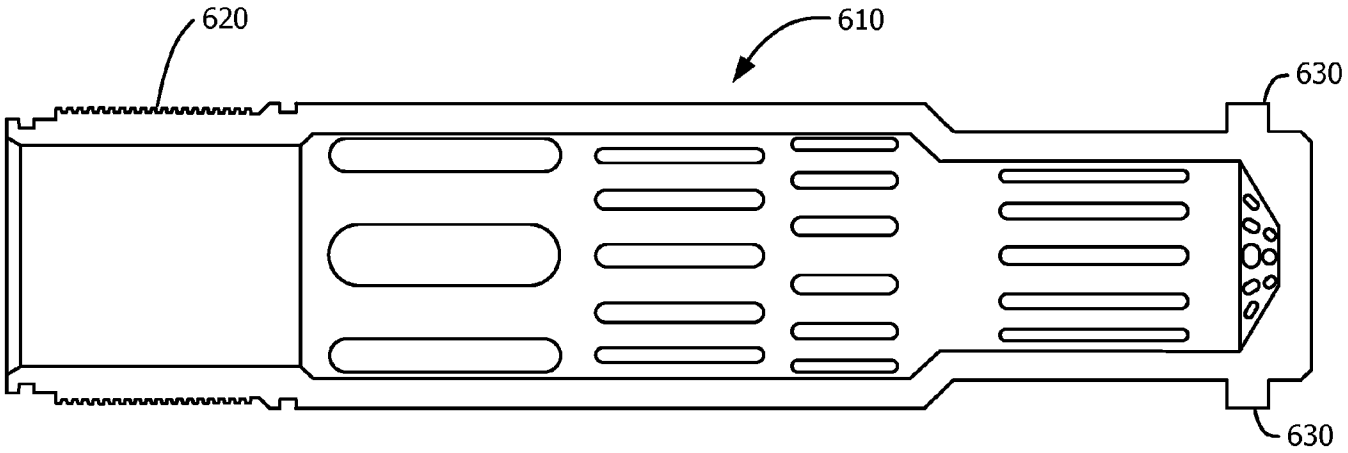
FIG. 6A illustrates another embodiment of a modified filter screen having an inner thread.
Figure 6B:
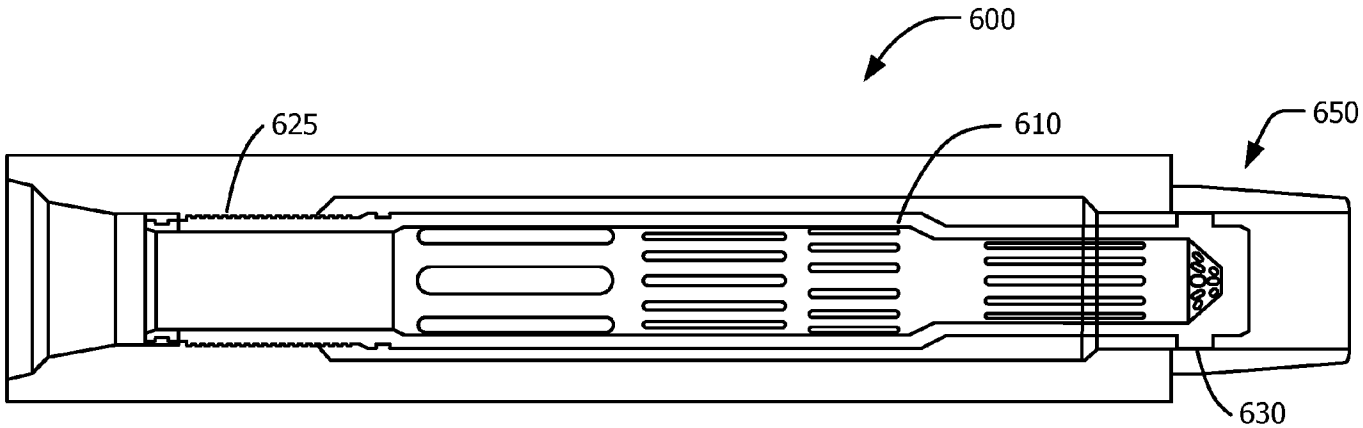
FIG. 6B illustrates the positioning of the modified filter screen of FIG. 6A in a top drive assembly.

Referring to FIGS. 6A and 6B, another embodiment of the modified filter screen is shown. FIG. 6A shows a modified filter screen 610, and FIG. 6B shows the modified filter screen 610 in filter sub 600. Instead of employing a J-latch, this embodiment of the modified filter screen 610 uses a threaded connector 620. The threaded connector 620 of the modified filter screen 610 mates with corresponding threads 625 on an inner surface of the filter sub 600, as shown in FIG. 6B. The threaded connection helps to securely attach the modified filter 610 into the filter sub 600. As also seen in this embodiment, the modified filter screen employs a different pattern of holes from that of the embodiment shown in FIGS. 4A and 4B. Any number of different hole arrangements or patterns could be used.

The modified filter screen 610 may be inserted through the pin end 650 of the filter sub 600. Notches 630 may be used to rotate the modified filter screen 610 to mate the threaded connector 620 to the corresponding threads 625 of the filter sub 600. A tool may be used to insert the modified filter screen 610 by latching onto the notches 630. The notches 630 may also act to centralize the open end of the filter screen within the pin end of the filter sub, as shown in FIG. 6B. The outer diameter of the filter screen at the notches 630 is preferably similar to, but smaller than, the inner diameter of the pin end of the filter sub. By reducing the gap between the outer diameter of the notches 630 and the inner diameter of the pin end of the filter sub, the horizontal moment of the filter screen may be reduced or eliminated and unintentional disengagement of the filter screen from the filter sub during handling and operations may be prevented.

In other embodiments, other retention mechanisms may be used to retain the filter screen within the filter sub. A pinned interface may be used. With such an interface, the filter screen may be inserted into the filter sub, and a pin may be inserted through the filter sub and filter screen to retain the filter screen within the filter sub. The pins, which may be spring-loaded or threaded set screws, are preferably easy to insert and remove to allow for installation and removal of the filter screen in the field. Similar to the dowel pins and J-latch described above, the retention pins would prevent circumferential and axial movement of the filter screen relative to the filter sub.

A retaining ring may also be used to retain the filter screen in the filter sub. The retaining ring may be a threaded or traditional retaining ring that engages the inner diameter of the filter sub below the filter screen. The retaining ring may be inserted below the filter screen after its insertion into the filter sub. A retaining ring would serve to prevent axial movement of the filter screen.

Although the concepts disclosed herein have been described in connection with the preferred form of practicing them and modifications thereto, those of ordinary skill in the art will understand that many other modifications can be made thereto. Accordingly, it is not intended that the scope of these concepts in any way be limited by the above description. Further it would be understood by those of ordinary skill in the art that features described in relation to one embodiment may be used in addition to, in combination with, or as a replacement for features described in relation to another embodiment.

The invention claimed is:

1. A top drive assembly used for downhole drilling, the top drive assembly comprising:

a filter sub housing, the filter sub housing comprising:

a box end having an internal diameter;

a threaded connector on the inner surface of the filter sub housing;

a pin end; and a first axial length between the box end and the pin end; and a filter screen, the filter screen comprising:

a bottom end having an internal diameter;

a top end having an internal diameter;

a second axial length between the bottom end and the top end; and a threaded connector of the filter screen disposed on the outer surface of the top end, wherein the threaded connector of the filter sub housing is engageable with the threaded connector of the filter screen to secure the filter screen in the filter sub housing; and wherein the first axial length is greater than the second axial length, such that when the threaded connectors are engaged the bottom end of the filter screen does not extend below the pin end of the filter sub housing.

2. The top drive assembly of claim 1, wherein the filter sub housing further comprises an internal shoulder separate from the threaded connector of the filter sub housing and disposed between the box end and the threaded connector of the filter sub housing.

3. The top drive assembly of claim 2, wherein:

the portion of the filter sub housing between the internal shoulder and the box end has an internal diameter; and the internal diameter of the filter sub housing between the internal shoulder and the box end is substantially similar to the internal diameter of the top end of the filter screen.

4. The top drive assembly of claim 1, wherein the filter screen is substantially cylindrical and the external diameter of the filter screen is substantially consistent.

5. The top drive assembly of claim 1, wherein the internal diameter of the filter screen at the top end is greater than the internal diameter of the filter screen at the bottom end.

6. The top drive assembly of claim 1, wherein the filter screen further comprises notches on the outer surface of the filter screen.

7. The top drive assembly of claim 6, wherein one or more of the notches is axially aligned with the pin end of the filter sub housing when the filter screen is secured in the filter sub housing.

8. The top drive assembly of claim 1, wherein the internal diameter of the box end of the filter sub housing is greater than the internal diameter of the top end of the filter screen.

9. The top drive assembly of claim 1, wherein the pin end of the filter sub housing is configured to engage with a drill string.

10. A method of locking a filter screen into a filter sub housing for a top drive assembly, the method comprising:

inserting the filter screen into a pin end of the filter sub housing;

rotating the filter screen to allow a threaded connector on the filter screen to engage with a threaded connector of the filter sub housing;

wherein the filter sub housing comprises the pin end and a box end with a first axial length therebetween, the filter screen comprises a bottom end and a top end with a second axial length therebetween, and the first axial length is greater than the second axial length, such that when the threaded connectors are engaged the bottom end of the filter screen does not extend below the pin end of the filter sub housing.

11. The method of claim 10, wherein the filter screen further comprises notches on the outer surface of the filter screen, and wherein rotating the filter screen comprises rotating the filter screen using one or more of the notches.

12. The method of claim 10, wherein:

the filter sub housing further comprises:

an internal shoulder disposed between the box end and the threaded connector; and an internal diameter between the box end and the internal shoulder;

the top end of the filter screen has an internal diameter; and the internal diameter of the filter sub housing between the box end and the internal shoulder is substantially similar to the internal diameter of the top end of the filter screen.

13. The method of claim 10, wherein the filter screen is substantially cylindrical and the external diameter of the filter screen is substantially consistent.

14. The method of claim 10, wherein:

the top end of the filter screen has an internal diameter;

the bottom end of the filter screen further has an internal diameter; and the internal diameter of the filter screen at the top end is greater than the internal diameter of the filter screen at the bottom end.

15. The method of claim 10, further comprising removing the filter screen by rotating the filter screen relative to the filter sub housing.

16. The method of claim 10, wherein the pin end of the filter sub housing is further configured to engage with a drill string.

* * * * *